US007621025B2

(12) United States Patent
Sanna

(10) Patent No.: US 7,621,025 B2
(45) Date of Patent: Nov. 24, 2009

(54) SLIDER FOR ZIP FASTENER WITH INTERCHANGEABLE PULL-TAB

(75) Inventor: Michele Sanna, Cologno Al Serio (IT)

(73) Assignee: Riri S.A. (CH)

( * ) Notice: Subject to any disclaimer, the term of this patent is extended or adjusted under 35 U.S.C. 154(b) by 26 days.

(21) Appl. No.: 11/719,502

(22) PCT Filed: Oct. 19, 2005

(86) PCT No.: PCT/IB2005/003454

§ 371 (c)(1),
(2), (4) Date: Jun. 16, 2008

(87) PCT Pub. No.: WO2006/054160

PCT Pub. Date: May 26, 2006

(65) Prior Publication Data

US 2009/0133232 A1 May 28, 2009

(30) Foreign Application Priority Data

Nov. 16, 2004 (CH) ..... 1883/04
Jul. 21, 2005 (CH) ..... 1215/05

(51) Int. Cl.
*A44B 19/30* (2006.01)

(52) U.S. Cl. ..... 24/421; 24/423; 24/424; 24/425; 24/429; 24/436

(58) Field of Classification Search ..... None
See application file for complete search history.

(56) References Cited

U.S. PATENT DOCUMENTS

| | | | | |
|---|---|---|---|---|
| 1,967,137 | A | 7/1934 | Sundback | |
| 2,322,526 | A | 6/1943 | Carlile | |
| 3,050,804 | A | 8/1962 | Morin | |
| 3,516,127 | A * | 6/1970 | Howell | 24/423 |
| 3,793,684 | A | 2/1974 | Moertel | |
| 5,864,928 | A | 2/1999 | Matsushima | |
| 6,654,988 | B1 * | 12/2003 | Chung | 24/421 |
| 2006/0112524 | A1 * | 6/2006 | Bernasconi | 24/422 |

* cited by examiner

*Primary Examiner*—Jack W. Lavinder
(74) *Attorney, Agent, or Firm*—Akerman Senterfitt

(57) ABSTRACT

A slider (1) for a zip fastener is described, said fastener comprising a base (2) and a back part (3) which are integral with each other and between which the rows of teeth (**4*i*) of the said fastener are arranged, as well as an engaging member (5) projecting upwards from the said back part (3) and able to be constrained to the connecting ring (6) of a pull-tab, the said engaging member (5) being shaped substantially in the manner of a U having a first side (7) of the two parallel sides (7, 8) fixed to the said base (2) and the second side (8) facing in a parallel manner the back part (3) and terminating in a hook-shaped portion (9) which is bent inwards, at least the third side (10**) of the U which connects said sides perpendicularly being flexurally resilient.

6 Claims, 5 Drawing Sheets

SLIDER FOR ZIP FASTENER WITH INTERCHANGEABLE PULL-TAB

The present invention relates to the sector of zip fasteners in which two rows of facing teeth are engaged and disengaged with/from each other by sliding a suitably shaped member, called slider, in both direct ions.

This slider is moved by operating a shaped plate, called pull-tab, which terminates in a ring which is constrained to an engaging member (also substantially ring-shaped) which projects upwards from the back part of the slider (the teeth of the fastener being arranged between said back part and a base integral therewith and facing it in a parallel manner).

Most frequently the said engaging member is a closed ring which forms a single body with the back of the slider and, in order to make the pull-tab interchangeable, it is required to modify the connecting ring of the latter, by designing it such that it can be opened in a resilient manner, but this results in structural complications and a certain structural weakness.

The Applicant is aware that efforts have been made to obtain the possibility of engaging and disengaging a pull-tab with/from a slider in an easy manner and without structural deformations, but the results obtained are not proportional to the additional costs and to the difficulties of manufacturing the various parts.

For example, in U.S. Pat. No. 5,864,928 the engaging member is open in the vicinity of the slider body, is pivotably mounted on the latter by means of a pin and is provided with a return spring which, acting on a transmission member, brings it back into the closed position after a pull-tab has been engaged with it.

The main drawback of this solution consists in the manufacturing complexity and the relatively high cost resulting from the number of parts to be made and assembled; these two aspects are moreover further aggravated by the fact that, in order to achieve locking of the slider in a desired position thereof with respect to the rows of teeth of the fastener, a further member is hinged on it and, operating in the manner of an escapement, inserts its free end between the said teeth.

It is obvious that the complexity of the constructional design described hitherto, in addition to having an impact on the costs, also has negative consequences as regards the solidity and working life of a slider.

The inventor of the object of the present application has devised a slider for a fastener which is simple and low-cost and which performs both the functions described above, i.e. allows engagement and disengagement of the pull-tab and locking thereof with the teeth of the fastener.

This slider, as will be seen below, is formed by securing together only two parts which have a simple design.

In the slider according to the invention, in fact, the engaging member described above is shaped substantially in the form of a U and the first of its two parallel sides is fixed to the said base of the slider, while the second side faces the said back part in a parallel manner and terminates in a hook-shaped portion directed towards the latter, and at least the third side which connects them perpendicularly is flexurally resilient.

By exerting on the said first side a force which tends to raise it from the back of the slider, it is possible, as a result of the flexibility of the second side (and also the third side, if applicable), to separate the abovementioned hook-shaped portion from the back of the slider by a distance sufficient to create a gap for introduction or extraction of the ring of a pull-tab.

When the engaging member is then released, its resilience brings it back into a closed position in which the ring of a pull-tab, which may be inserted inside it, remains firmly constrained there, and the form of the abovementioned hook portion, which is also bent inwards in the direction of the third side, prevents the ring of the slider from being removed when a pulling force oriented in any direction is exerted on it.

The hook-shaped part of the said U-shaped engaging member is inserted into a recess formed on the back of the slider and, if this recess is a through-recess, it reaches the teeth of the fastener which are situated inside the slider, being inserted between them and in fact locking the fastener.

The object of the invention therefore consists of a slider for a fastener as described in the accompanying claim 1.

A preferred example of embodiment of the slider according to the invention will now be described in more detail, with reference also to the accompanying drawings in which.

Figure 1:
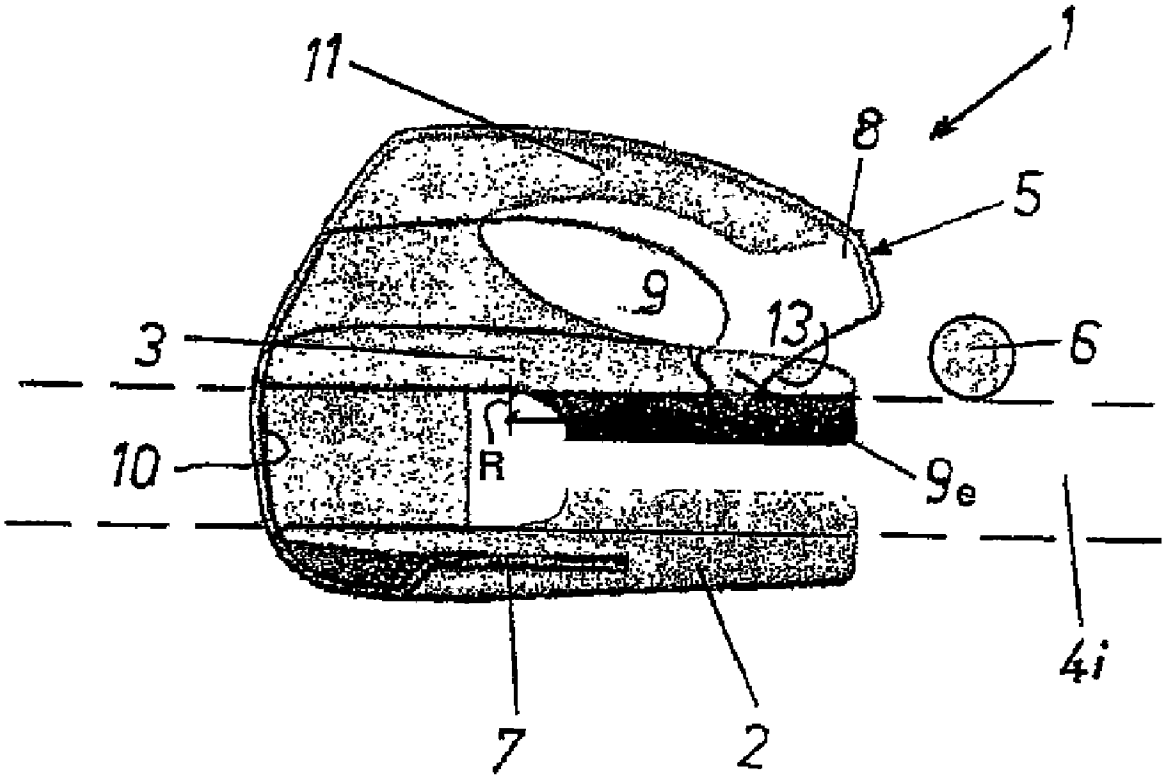
FIGS. 1 to 6 are enlarged and partly cut-away side views which show a succession of positions of the parts during engagement of the ring of a pull-tab with the said example of embodiment of the slider according to the invention.
Figure 3:
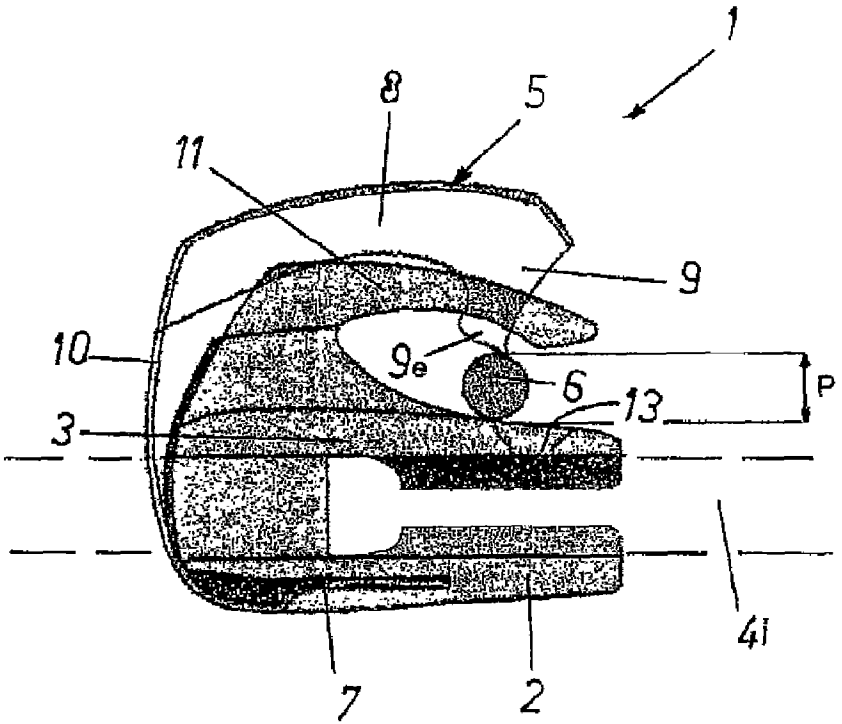
Figure 2:
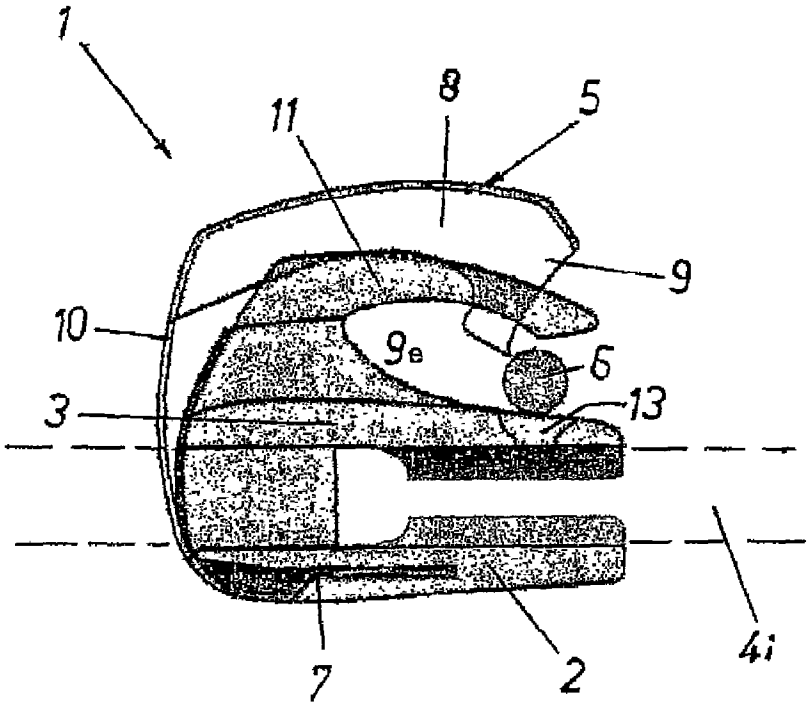
Figure 5:
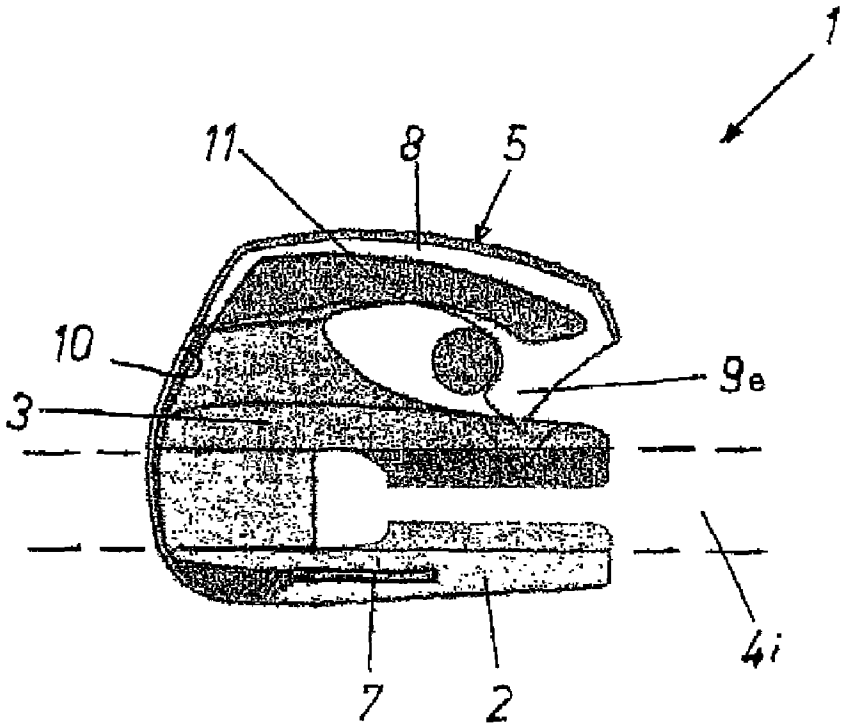
Figure 4:
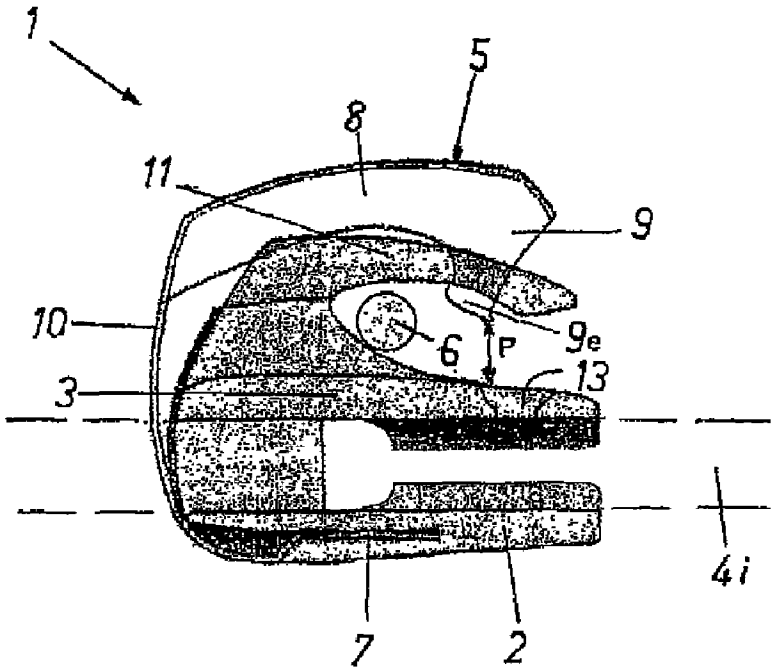
Figure 6:
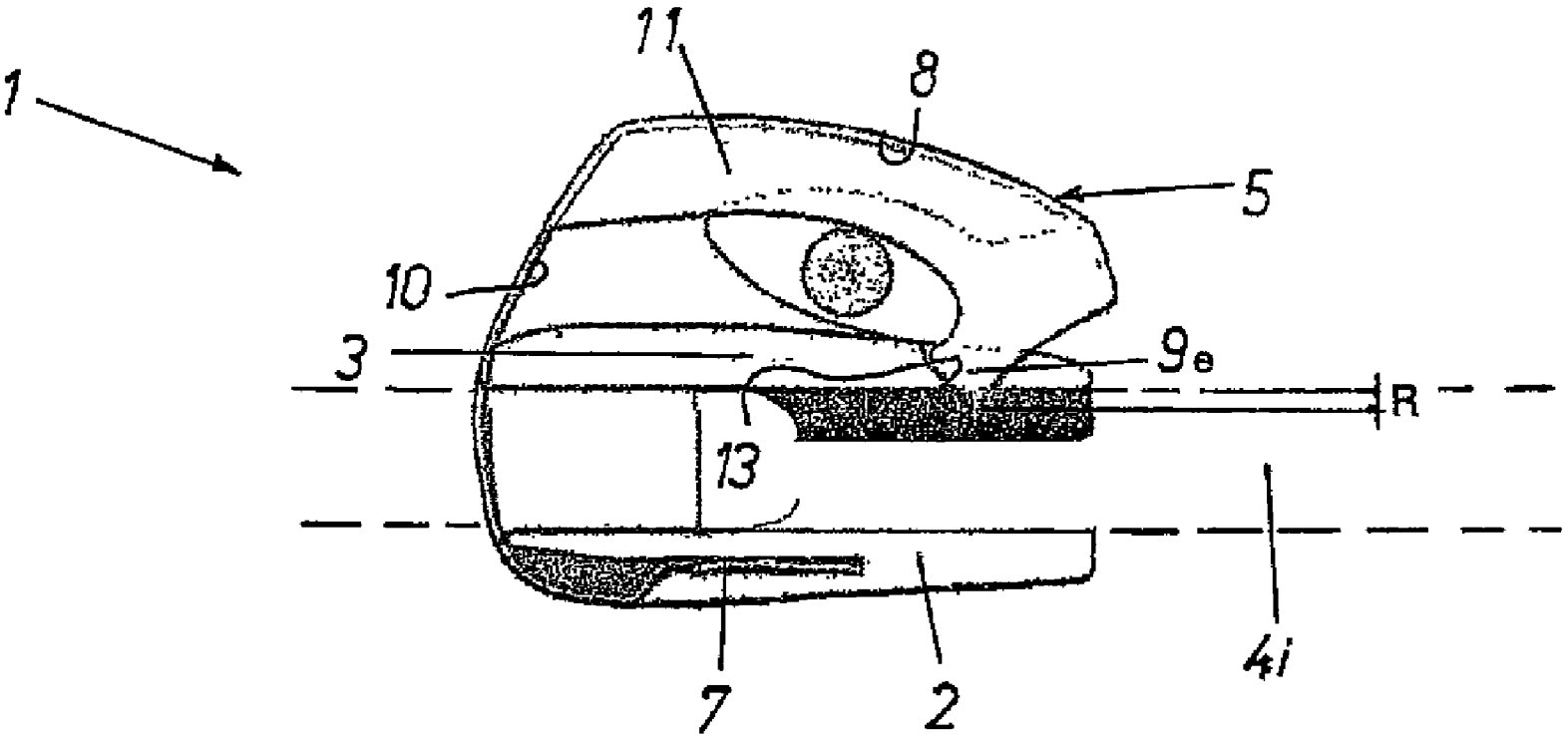

In FIGS. 1 to 6 it can be seen how the slider 1 according to the invention comprises, in accordance with known criteria, a base 2 and a back part 3 integral therewith, between which the rows of teeth 4*i* of a fastener (only schematically indicated in the drawings) are arranged, as well as an engaging member 5 projecting upwards from said back part 3 and able to be constrained to the connecting ring 6 of a pull-tab (not shown in its entirety). Consequently, the slider 1 is composed solely of two parts secured together and consisting of the slider body and the engaging member 5.

In the slider 1 of the invention the said engaging member 5 is shaped substantially in the form of a U and of this U a first side 7 of its two parallel sides 7, 8 is fixed to the said base 2, the second side 8 faces in a substantially parallel manner the back part 3 and terminates in a hook-shaped portion 9 bent inwards and the third side 10 which connects perpendicularly the other two sides is flexurally resilient.

It should be noted that, if necessary, one of the two said parallel sides 7, B, or both of them, may also possess this flexural resilience.

As can be seen from the drawings, by exerting a force which tends to separate the said first side 7 of the engaging member, a passage P is created such as to allow insertion (as shown in the Figures) or disengagement of the connecting ring 6 of a pull-tab, also allowing the removal and/or replacement of the latter with extreme ease.

When the said engaging member 5 is released, it is rearranged in its initial closed position and, owing to the form of its hook-shaped portion 9, which in particular is bent at its free end 9*e* inwards, namely towards the third side 10 of the said U, it prevents accidental extraction of the said connecting ring 6 as a result of a force exerted in any direction.

Advantageously, and in order to impart a greater rigidity to the assembly, the inventor has envisaged forming on the back part 3 of the slider 1 of the invention a recess 13 which is designed to receive, preferably in a complementary manner, the said free end 9*c* of the hook-shaped portion 9 with which the engaging member 5 terminates, preventing transverse movements thereof which could occur following impacts or other similar events.

Since the engaging member 5 may be formed with a limited transverse thickness, the inventor has also envisaged that two protective and reinforcing flanges 11, 12 extend from the back part 3 of the slider 1, being arranged alongside the said engaging member 5 in a parallel manner on opposite sides thereof.

Figure 7:
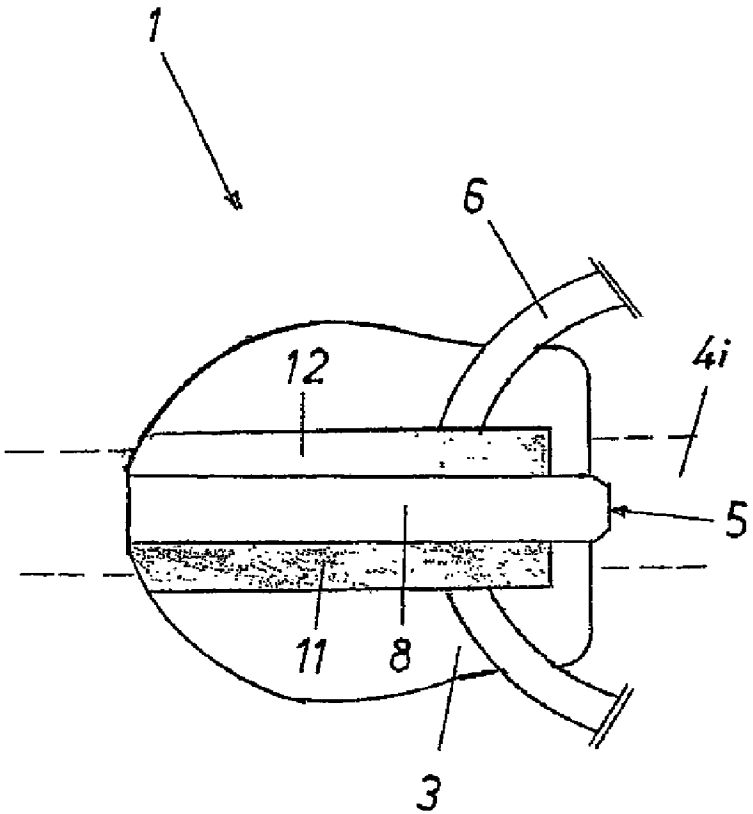
FIG. 7 is a plan view of the same slider shown in the preceding figures.

The profile of these flanges 11, 12 is similar to that of the said first and second side 7, 8 of the U forming the shape of the engaging member 5, so as to cover the latter and protect it from transverse stresses (see also FIG. 7 in this connection).

Figure 8:
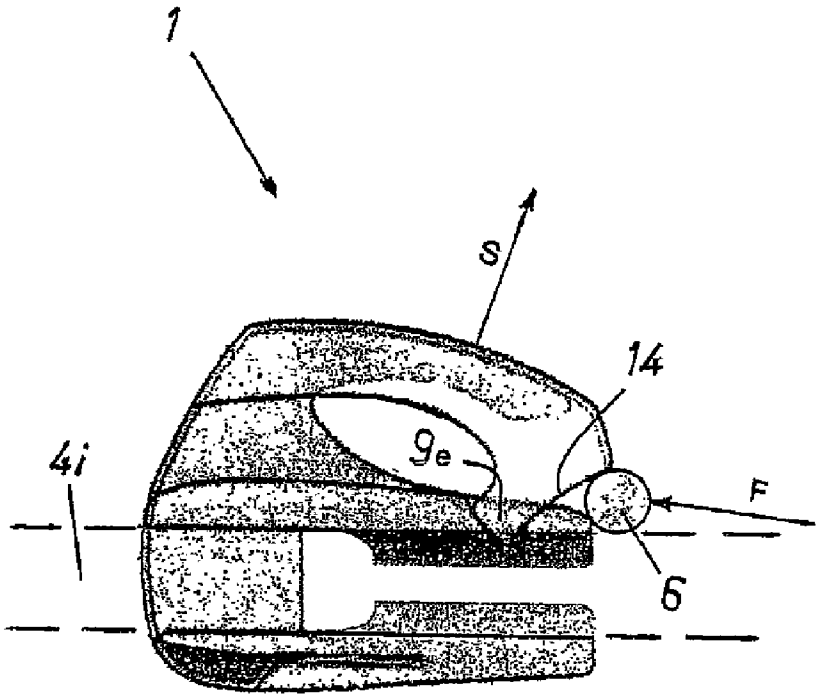
FIG. 8 is an enlarged and partly cut-away transverse view of the example of embodiment according to the preceding figures, showing how a chamfer on the end of the hook-shaped portion facilitates insertion of the ring of a slider.

A further measure envisaged by the inventor consists in the possibility of providing a chamfer 14 on the free end 9*e* of the already described hook-shaped portion 9 which is received inside the said recess 13. The profile of this chamfer has an inclination such as to allow insertion of the pull-tab ring 6 between said chamfer and the surface of the said back part 3 from the outside inwards. This insertion, which is performed by pressing with a force F (see FIG. 8) parallel to the back part 3 of the slider 1, exerted by means of the connecting ring 6, causes, as a result of the inclined surface, raising of the engaging member (arrow S), overcoming its flexural resistance and lifting it so as to allow and facilitate insertion of the said ring 6.

As can be seen in the various figures, the said recess may be a through-recess, as in the example illustrated, so as to allow the said free end 9*c* of the engaging member 9 to reach the zone occupied by the teeth 4*i* and be wedged between them, over a depth R (shown in FIGS. 1, 6) of even only a few tenths of mm, preventing further movements of the slider 1 and locking in fact the associated fastener.

Unlocking of the fastener occurs automatically since, in order to move the slider 1 in any direction, it is basically required to exert a force which has at least one component in a direction (S in FIG. 8) which causes slight flexing of the engaging member 5 so as to open it and this flexing action is sufficient to raise the already described free end 9*e* thereof over a depth F, extracting it from the zone occupied by the teeth 4*i* and freeing the slider 1.

The automatic locking and unlocking operations described above are not illustrated with drawings since they may be easily understood and imagined by a person skilled in the art.

If it is not required to obtain this "automatic" locking action, it is sufficient to design the recess 13 so that it has a "blind" form with a smaller depth (this possibility is not illustrated in the drawings).

With the slider according to the invention, which is made of only two parts and therefore is simple and inexpensive to manufacture, it is possible to perform all the functions described above, namely: engagement and disengagement of the pull-tab easily, without any mechanical operations and without permanent deformations, as well as simple locking of the slider on the fastener.

The invention claimed is:

1. Slider for a zip fastener, comprising a base and a back part which are integral with each other and between which the rows of teeth of the said fastener are arranged, as well as an engaging member projecting upwards from the said back part and able to be constrained to the connecting ring of a pull-tab, the said engaging member being shaped substantially in the manner of a U having a first side of the two parallel sides fixed to the said base and the second side facing in a parallel manner the back part and terminating in a hook-shaped portion which is bent inwards, wherein at least the third side of the U which connects said sides perpendicularly is flexurally resilient thereby making said hook-shaped portion movable from a closing position, which constrains said ring of the pull-tab inside said engaging member, and a position wherein said hook-shaped portion is separated from said back part by a distance sufficient to create a gap for introduction or extraction of said ring of the pull-tab.

2. Slider according to claim 1, in which two rigid flanges, which project from the said back part with which they are integral, are arranged alongside the said engaging member in a parallel manner on opposite sides, the profile of the said flanges being similar to the profile of the said first and second sides of the U forming the shape of the engaging member in the position which it assumes when no force is exerted thereon.

3. Slider according to claim 1, in which the said back part has, formed therein, a recess able to receive the free end of the said hook-shaped portion with which the abovementioned engaging member terminates.

4. Slider according to claim 3, in which the said recess is a through-recess and has a size such as to allow the said free end of the engaging member to reach the zone occupied by the teeth and be wedged between them over a predefined depth in order to prevent movements of the slider.

5. Slider according to claim 1, in which the profile of the free end of the said hook-shaped portion is curved inwards towards the said third side of the said U forming the shape of the engaging member which joins together its first side and its second side.

6. Slider according to claim 1, in which a chamfer is formed on the outer surface of the free end of the said hook-shaped portion which is received inside the said recess, said chamfer having an inclination such as to allow insertion of the connecting ring of the pull-tab between itself and the said back part from the outside inwards, this insertion movement having the effect of raising the said engaging member, overcoming its flexural resistance, and raising it so as to allow the connecting ring of the pull-tab to pass through.

* * * * *